US007883204B2

(12) United States Patent
Shinkawa et al.

(10) Patent No.: US 7,883,204 B2
(45) **Date of Patent: *Feb. 8, 2011**

(54) INK JET PRINTER

(75) Inventors: Osamu Shinkawa, Chino (JP); Yusuke Sakagami, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 591 days.

This patent is subject to a terminal disclaimer.

(21) Appl. No.: 11/950,510

(22) Filed: Dec. 5, 2007

(65) Prior Publication Data

US 2008/0136890 A1 Jun. 12, 2008

(30) Foreign Application Priority Data

Dec. 7, 2006 (JP) ..... 2006-330163

(51) Int. Cl.
*B41J 2/01* (2006.01)
*B41J 2/385* (2006.01)

(52) U.S. Cl. ..... 347/104; 347/102; 271/197

(58) Field of Classification Search ..... 347/17, 347/101, 102, 104, 141; 271/197
See application file for complete search history.

(56) References Cited

U.S. PATENT DOCUMENTS 6,243,118 B1 * 6/2001 Akichika et al. ..... 347/155
6,935,735 B2 * 8/2005 Tanikawa et al. ..... 347/103
7,044,592 B2 * 5/2006 Sato et al. ..... 347/100
7,722,180 B2 * 5/2010 Mashima ..... 347/104
7,771,039 B2 * 8/2010 Sakagami ..... 347/102
2002/0067403 A1 6/2002 Smith
2003/0132996 A1 * 7/2003 Adachi ..... 347/102
2008/0094459 A1 4/2008 Sakagami

FOREIGN PATENT DOCUMENTS

JP 10-151733 6/1998
JP 10-229688 8/1998
JP 10272828 A * 10/1998
JP 2000-177907 6/2000
JP 2005-178251 7/2005
JP 2005-178252 7/2005

OTHER PUBLICATIONS

U.S. Appl. No. 11/873,552, Mail Date Oct. 29. 2009, Office Action.

* cited by examiner

*Primary Examiner*—Daniel Petkovsek
(74) *Attorney, Agent, or Firm*—Workman Nydegger

(57) ABSTRACT

An ink jet printer includes: ink jet heads that discharge aqueous ink droplets onto a printing surface of a printing medium that is transported in a predetermined direction; a vapor supply unit that is provided at a downstream side of the ink jet head in a direction in which the printing medium is transported and supplies vapor to a surface of the printing medium opposite the printing surface of the printing medium having the liquid droplets discharged from the ink jet heads in a non-contact manner; and a vapor electrostatic deposition unit that deposits the vapor supplied from the vapor supply unit to the surface of the printing medium opposite the printing surface of the printing medium using electrostatic force.

7 Claims, 10 Drawing Sheets

INK JET PRINTER

BACKGROUND

1. Technical Field

The present invention relates to an ink jet printer that discharges minute liquid ink droplets having a plurality of colors from a plurality of nozzles to form fine particles (ink dots) on a printing medium, thereby printing a predetermined character or image.

2. Related Art

In general, such an ink jet printer is inexpensive and can easily produce a high-quality color print out. With the popularization of personal computers and digital cameras, ink jet printers have come into widespread use in the home as well as in the office.

Generally, in such an ink jet printer, nozzles of printing heads (which are also called ink jet heads) discharge (eject) liquid ink droplets onto a printing medium while a moving body, which is called a carriage composed of ink cartridges and the printing heads, reciprocates over the printing medium in a direction orthogonal to the direction in which the printing medium is transported, thereby forming minute ink dots on the printing medium. In this way, the ink jet printer prints a desired character or image on the printing medium to produce a desired print out. The carriage is provided with four color (black, yellow, magenta, and cyan) ink cartridges and printing heads corresponding to the four colors, which makes it possible to easily perform full color printing using the four colors as well as monochrome printing (six, seven, or eight color printing including black, yellow, magenta, cyan, light cyan, and light magenta has also been put to practical use).

In the ink jet printer that performs printing while reciprocating the ink jet heads on the carriage in the direction (in the width direction of the printing medium) orthogonal to the direction in which the printing medium is transported, in order to completely print one page, it is necessary to reciprocate the ink jet heads a number of times ranging from several tens of times to one hundred times or more. In contrast, in an ink jet printer that uses long ink jet heads having a length equal to the width of a printing medium without using the carriage, it is not necessary to move the ink jet heads in the width direction of the printing medium, and only one pass is required to print the printing medium, which makes it possible to perform high-speed printing, similar to an electrophotographic printer. The former is generally called a 'multi-pass ink jet printer', and the latter is generally called a 'line head ink jet printer'.

However, when aqueous ink is used for the ink jet printer, the printing medium is curved after printing, that is, so-called curling occurs in the printing medium after printing. In order to prevent the curling, JP-A-10-151733 discloses an ink jet printer in which a roller comes into contact with the surface of the printing medium opposite a printing surface of the printing medium immediately after printing to apply a curl-preventing liquid onto the printing medium, and the printing medium passes through a heat roller heater having heating sources at the upper and lower parts thereof to be dried. In addition, JP-A-2005-178251 discloses an ink jet printer in which, in order to prevent the curling, a vapor generating device for generating vapor using heat or ultrasonic vibration is provided inside a roller for transporting a printing medium, and the roller comes into contact with the printing medium to supply vapor from the surface of the roller to the surface of the printing medium opposite the printing surface of the printing medium. Further, JP-A-2005-178252 discloses a technique for detecting humidity in a printing environment and controlling the amount of vapor generated according to the environmental humidity in the ink jet printer disclosed in JP-A-2005-178251.

However, in the ink jet printers disclosed in JP-A-10-151733, JP-A-2005-178251, and JP-A-2005-178252, the roller comes into contact with the printing medium to supply a liquid, such as the curl-preventing liquid, or vapor. However, a printing medium containing a large amount of liquid is likely to be closely adhered to the roller, that is, the detachability between the roller and the printing medium is lowered, which may result in an error in the transport of a printing medium.

SUMMARY

An advantage of some aspects of the invention is that is provides an ink jet printer capable of effectively preventing the curling of a printing medium without errors in the transport of the printing medium.

According to a first aspect of the invention, an ink jet printer includes: ink jet heads that discharge aqueous ink droplets onto a printing surface of a printing medium that is transported in a predetermined direction; a vapor supply unit that is provided at a downstream side of the ink jet head in a direction in which the printing medium is transported and supplies vapor to a surface of the printing medium opposite the printing surface of the printing medium having the liquid droplets discharged from the ink jet heads in a non-contact manner; and a vapor electrostatic deposition unit that deposits the vapor supplied from the vapor supply unit to the surface of the printing medium opposite the printing surface of the printing medium using electrostatic force.

The inventor examines the curling of a printing medium, and obtains the following result. That is, two kinds of curling occur in printing media: first, curling occurring when ink droplets are discharged onto a printing medium, that is, curling immediately after printing; and second, curling occurring after ink droplets are dried, that is, curling after ink is dried. In general, the directions of the two curls are opposite to each other. In addition, the direction of curling depends on the direction of cellulose fibers forming a printing medium. In order to prevent the curling of a printing medium, it is effective to reduce the difference between the amount of water contained in the printing surface having ink droplets discharged thereto and the amount of water in the opposite surface thereof. Meanwhile, when a small amount of ink is discharged onto one printing medium, the curling does not occur.

According to the ink jet printer of the first aspect, the vapor supply unit provided at the downstream side of the ink jet head in the direction in which the printing medium is transported supplies vapor to the surface of the printing medium opposite the printing surface of the printing medium onto which aqueous ink droplets are discharged from the ink jet head in a non-contact manner. The vapor supplied from the vapor supply unit is deposited to the surface of the printing medium opposite the printing surface of the printing medium by electrostatic force. According to the above-mentioned structure, errors in the transport of the printing medium do not occur, and charge is likely to be concentrated on aqueous ink droplets, which are conductors, resulting in a strong electric field. The strong electric field enables a larger amount of vapor to be deposited to the printing medium. Therefore, a large amount of vapor is deposited to a portion having a large number of ink droplets discharged thereto. As a result, the difference between the amount of water in the printing surface of the printing medium and the amount of water in the surface opposite the printing surface is reduced, which makes it possible to effectively and reliably prevent the curling of the printing medium.

According to a second aspect of the invention, in the ink jet printer according to the first aspect, preferably, the vapor electrostatic deposition unit includes a pair of electrodes that are provided so as to be opposite to each other in a direction in which the vapor supply unit supplies the vapor and to face the printing medium.

According to the ink jet printer of the second aspect, it is possible to effectively prevent the curling of a printing medium with a simple structure.

According to a third aspect of the invention, in the ink jet printer according to the second aspect, preferably, the electrode includes a dew condensation preventing heater.

According to the ink jet printer of the third aspect, since the electrode includes the dew condensation preventing heater, it is possible to prevent dew condensation or the drop of dew to the printing medium due to the deposition of vapor.

According to a fourth aspect of the invention, in the ink jet printer according to the second or third aspect, preferably, vapor vents are formed in the electrode.

According to the ink jet printer of the fourth aspect, since the vapor vents are formed in the electrode, it is possible to prevent dew condensation or the drop of dew to a printing medium due to the deposition of vapor.

According to a fifth aspect of the invention, in the ink jet printer according to the first aspect, preferably, the vapor electrostatic deposition unit includes a printing medium charging unit for charging the printing medium.

According to the ink jet printer of the fifth aspect, vapor is deposited to the surface of the printing medium opposite the printing surface of the printing medium by the printing medium charging unit for charging a printing medium. Therefore, it is possible to effectively prevent the curling of a printing medium with a simple structure.

According to a sixth aspect of the invention, in the ink jet printer according to the fifth aspect, preferably, the printing medium charging unit is provided at an upstream side of the ink jet head in the direction in which the printing medium is transported.

According to the ink jet printer of the sixth aspect, since the printing medium charging unit is provided at the upstream side of the ink jet head in the direction in which the printing medium is transported, it is possible to easily implement the invention.

According to a seventh aspect of the invention, in the ink jet printer according to the fifth aspect, preferably, the printing medium charging unit is provided at the downstream side of the ink jet head and at the upstream side of the vapor supply unit in the direction in which the printing medium is transported.

According to the ink jet printer of the seventh aspect, since the printing medium charging unit is provided at the downstream side of the ink jet head and at the upstream side of the vapor supply unit in the direction in which the printing medium is transported, it is possible to easily implement the invention.

According to an eighth aspect of the invention, in the ink jet printer according to the first aspect, preferably, the vapor supply unit includes: a vapor generating unit that generates vapor on the side of the printing medium opposite the printing surface of the printing medium onto which the ink droplets are discharged from the ink jet head; and a suction unit that sucks air from the printing surface of the printing medium to generate the flow of vapor from the side of the printing medium opposite the printing surface to the printing surface.

According to the ink jet printer of the eighth aspect, vapor is generated on the side of the printing medium opposite the printing surface onto which the ink droplets are discharged from the ink jet head, and air is sucked from the printing surface of the printing medium to generate the flow of vapor from the side of the printing medium opposite the printing surface to the printing surface. Therefore, the vapor generated on the side of the printing medium opposite the printing surface of the printing medium is actively deposited to the surface of the printing medium opposite the printing surface of the printing medium. As a result, the difference between the amount of water in the printing surface of the printing medium and the amount of water in the opposite surface thereof is effectively reduced.

According to a ninth aspect of the invention, in the ink jet printer according to the eighth aspect, preferably, the vapor generating unit generates vapor by dropping water onto a heated member.

According to the ink jet printer of the ninth aspect, water is dropped to a heated member to generate vapor. Therefore, it is possible to simplify the structure of an apparatus, easily implement the invention, and generate a large amount of vapor in a short time.

According to a tenth aspect of the invention, preferably, the ink jet printer according to the first aspect further includes a vapor supply control unit that controls the supply of the vapor from the vapor supply unit to the printing medium according to the ratio of the number of nozzles for discharging the ink droplets from the ink jet head to the total number of nozzles.

According to the ink jet printer of the tenth aspect, the supply of the vapor from the vapor supply unit to the printing medium is controlled according to the ratio of the number of nozzles for discharging the ink droplets from the ink jet head to the total number of nozzles. Therefore, for example, in the case in which the ratio of the number of nozzles discharging ink droplets to the total number of nozzles is more than a predetermined value, that is, a large amount of ink is discharged onto one printing medium, when the vapor supply unit supplies vapor to the printing medium in a non-contact manner, it is possible to reduce energy consumption and prevent the curling of a printing medium 2.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer according to a first embodiment of the invention will be described with reference to the accompanying drawings.

Figure 1:
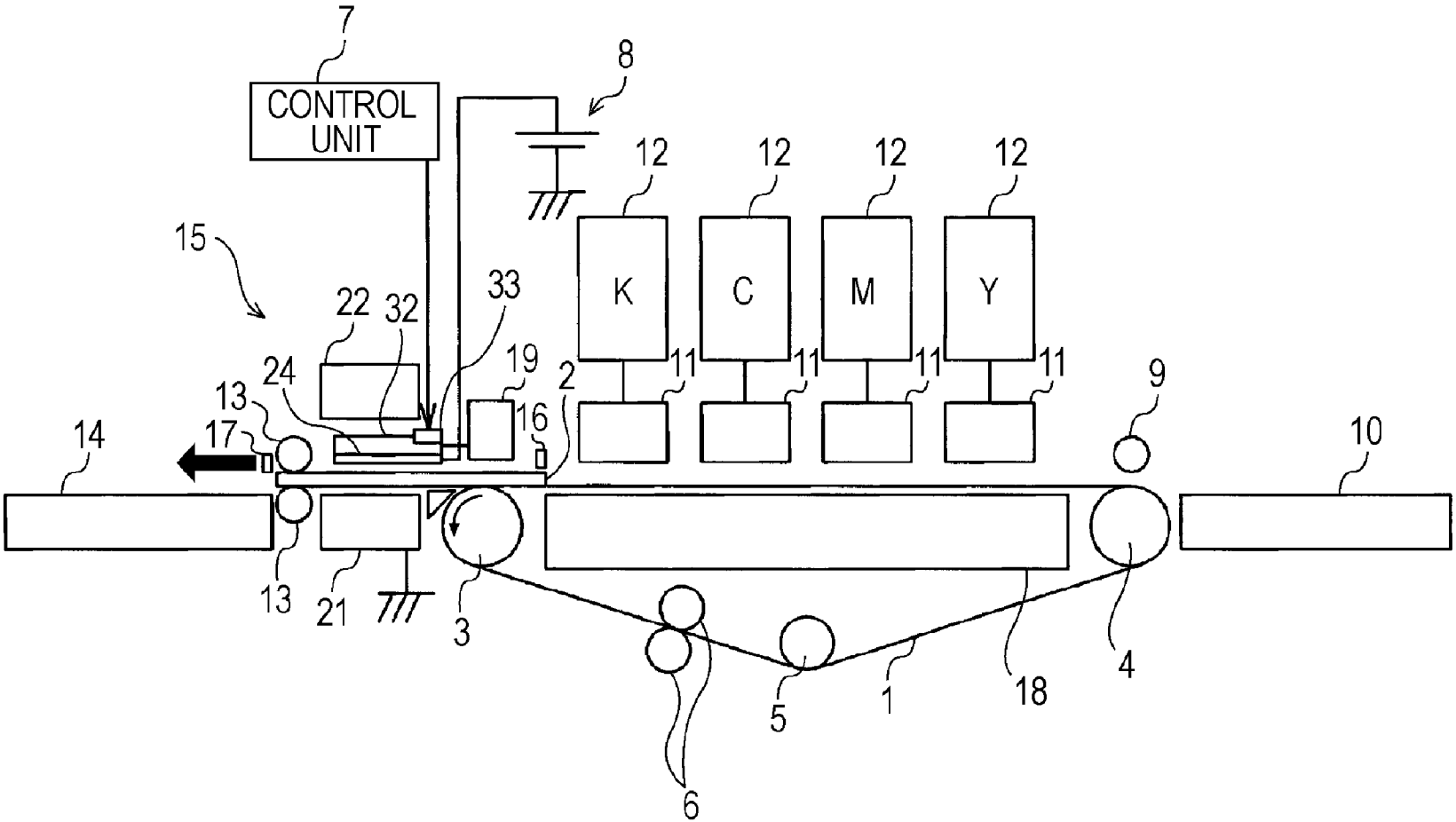
FIG. 1 is a front view schematically illustrating the structure of an ink jet printer according to a first embodiment of the invention.

FIG. 1 is a front view schematically illustrating the structure of the ink jet printer according to this embodiment. In the drawings, reference numeral 1 indicates a transport belt for transporting a printing medium 2. The transport belt 1 is formed of, for example, polyimide, polycarbonate, polyvinylidene fluoride (PVDF), tetrafluoroethylene-ethylene copolymer (ETFE) tetrafluoroethylene-perfluoroalkylvinylether (PPFA) tetrafluoroethylene-hexafluoropropylene copolymer (FEP), polychlorotrifluoroethylene (PCTFE), or mixtures of these materials and elastomer. In addition, the transport belt 1 may be formed in a single-layer structure or a two-layer structure made of the above-mentioned materials. Further, a conductive material, such as carbon, may be added to the single-layer or two-layer structure to adjust the electric resistance thereof.

The transport belt 1 is wound around a driving roller 3 that is provided at the center of FIG. 1, a driven roller 4 that is provided at a right end of FIG. 1, and a tension roller 5 that is provided at a lower middle side of the driven and driving rollers. The driving roller 3 is rotated by a transport belt motor (not shown) in the direction of an arrow in FIG. 1 to transport a printing medium 2 loaded on the transport belt 1 from the right side to the left side in FIG. 1, that is, in the direction of the arrow in an air suction method. In addition, the tension roller 5 is urged downward by a spring (not shown) to apply tension to the transport belt 1. In FIG. 1, reference numeral 6 indicates a belt cleaner that removes a mist of ink discharged from an ink jet head, which will be described later, from the transport belt 1. The belt cleaner 6 is formed of, for example, felt rollers.

A sheet pressing roller 9 is provided above the driven roller 4. The sheet pressing roller 9 is urged downward by a spring (not shown) and presses the printing medium 2 fed from a sheet feeding unit 10 against the transport belt 1 wound around the driven roller 4. For example, when the sheet pressing roller 9 presses the printing medium 2 to the outer circumferential surface of the transport belt 1 while the air between the outer circumferential surface of the transfer belt 1 and the printing medium 2 is extracted using an air suction unit (not shown), the printing medium 2 is sucked to the outer circumferential surface of the transport belt 1. In addition, a vapor supply apparatus 15 is provided at the downstream side of the transport belt 1 in the direction in which the printing medium 2 is transported, and a sheet discharge roller 13 for discharging the printing medium 2 is provided at the downstream side of the vapor supply apparatus 15 in the direction in which the printing medium 2 is transported. Therefore, after printing is performed on the printing medium 2 in a printing area, the vapor supply apparatus 15 supplies vapor to the printing medium 2, and a sheet discharging unit 14 discharges the printing medium 2. Further, a first optical sensor 16 for detecting the printing medium 2 is provided at the upstream side of the vapor supply apparatus 15 in the direction in which the printing medium 2 is transported, and a second optical sensor 17 for detecting the printing medium 2 is provided at the downstream side of the vapor supply apparatus 15 in the direction in which the printing medium 2 is transported.

In FIG. 1, reference numeral 11 indicates a line ink jet head. The ink jet heads 11 are provided to correspond to four colors, that is, yellow (Y), magenta (M), cyan (C) and black (K), in a direction different from the direction in which the printing medium 2 is transported. The ink jet heads 11 are supplied with ink from Y, M, C, and K ink cartridges 12 through ink supply tubes. A plurality of nozzles are provided in each of the ink jet heads 11 in a direction intersecting the direction in which the printing medium 2 is transported, and a necessary amount of ink droplets is simultaneously discharged from the nozzles to desired positions to form minute ink dots on the printing medium 2. This process is performed for each color, which makes it possible to perform printing on the printing medium 2 on the transport belt 1 with only one pass of the printing medium 2, which is called one-pass printing. That is, the arrangement area of the ink jet heads 11 corresponds to a printing area.

In order to discharge ink from the nozzles of the ink jet head, for example, an electrostatic method, a piezo-electric method, or a film boiling ink jet method is used. In the electrostatic method, when a driving signal is input to an electrostatic gap, serving as an actuator, a diaphragm in a cavity is deformed to vary the internal pressure of the cavity, which causes ink droplets to be discharged from the nozzles. In the piezo-electric method, when a driving signal is input to a piezo-electric element, serving as an actuator, a diaphragm in the cavity is deformed to vary the internal pressure of the cavity, which causes ink droplets to be discharged from the nozzles. In the film boiling ink jet method, a minute heater is provided in the cavity, and the heater instantaneously heats ink to a temperature of 300° C. or more to be in a film boiling state. Then, bubbles are generated, and the internal pressure of the cavity varies, which causes ink droplets to be discharged from the nozzles. In this embodiment, any of the above-mentioned methods can be used. In addition, it is assumed that aqueous ink is used.

A cleaning unit 18 for restoring the nozzles provided in the ink jet heads 11 is provided inside the transport belt 1 that is provided below the ink jet heads 11 forming the printing area. The cleaning unit 18 includes a cap capable of airtightly covering nozzle surfaces of the ink jet heads 11, and an ink absorbing material is provided on the bottom of the cap. In addition, a negative pressure generating unit, such as a tube pump, is connected to the cleaning unit 18, and the cleaning unit 18 is moved up and down by a lifting unit (not shown).

In an ink jet printer provided with the line ink jet head 11, the ink droplets may not be discharged from the nozzles of the ink jet heads 11, that is, an ink droplet discharge error (no ink droplet is discharged), which is called ink dot non-discharge, may occur due to the cutoff of ink, the generation of bubbles, plugging (drying), or the adhesion of paper powder. The paper powder is likely to be generated when a printing medium made from wood pulp comes into friction contact with a roller, and refers to a fiber or an aggregate of the fibers.

In this embodiment, the paper power is cleaned or flushed by the cleaning unit 18, if necessary.

For example, when the lifting unit lifts the cap of the cleaning unit 18 to closely adhere to the nozzle surfaces of the ink jet heads 11 and a negative pressure is formed inside the cap by the negative pressure generating unit, ink is sucked from the nozzles to the inside of the cap. The ink in the cap is sucked to, for example, a waste ink tank (not shown) by the negative pressure generating unit, thereby restoring the nozzles. This nozzle restoring method is called cleaning. Another restoring method of discharging only the ink droplets beforehand, without sucking ink, may be used, which is called flushing.

In the flushing method, since it is not necessary to lift the cap of the cleaning unit 18 to be closely adhered to the nozzle surface of the ink jet heads 11, flushing is performed without lifting the cap. That is, the nozzle surfaces of the ink jet heads 11 and the cap of the cleaning unit 18 are disposed opposite each other with the transport belt 1 interposed therebetween in a front view. Therefore, the transport belt 1 is provided with nozzle restoring openings passing the ink discharged from the nozzles of the ink jet head 11 toward the cap of the cleaning unit 18. The nozzle restoring openings are formed in the transport belt 1 such that they simultaneously face a plurality of ink jet heads 11 that are formed in a zigzag pattern at a predetermining timing during one rotation of the transport belt 1. Therefore, it is possible to restore all of the nozzles at the same time by performing a process of preventing plugging at a predetermined timing during one rotation of the transport belt 1.

Figure 2:
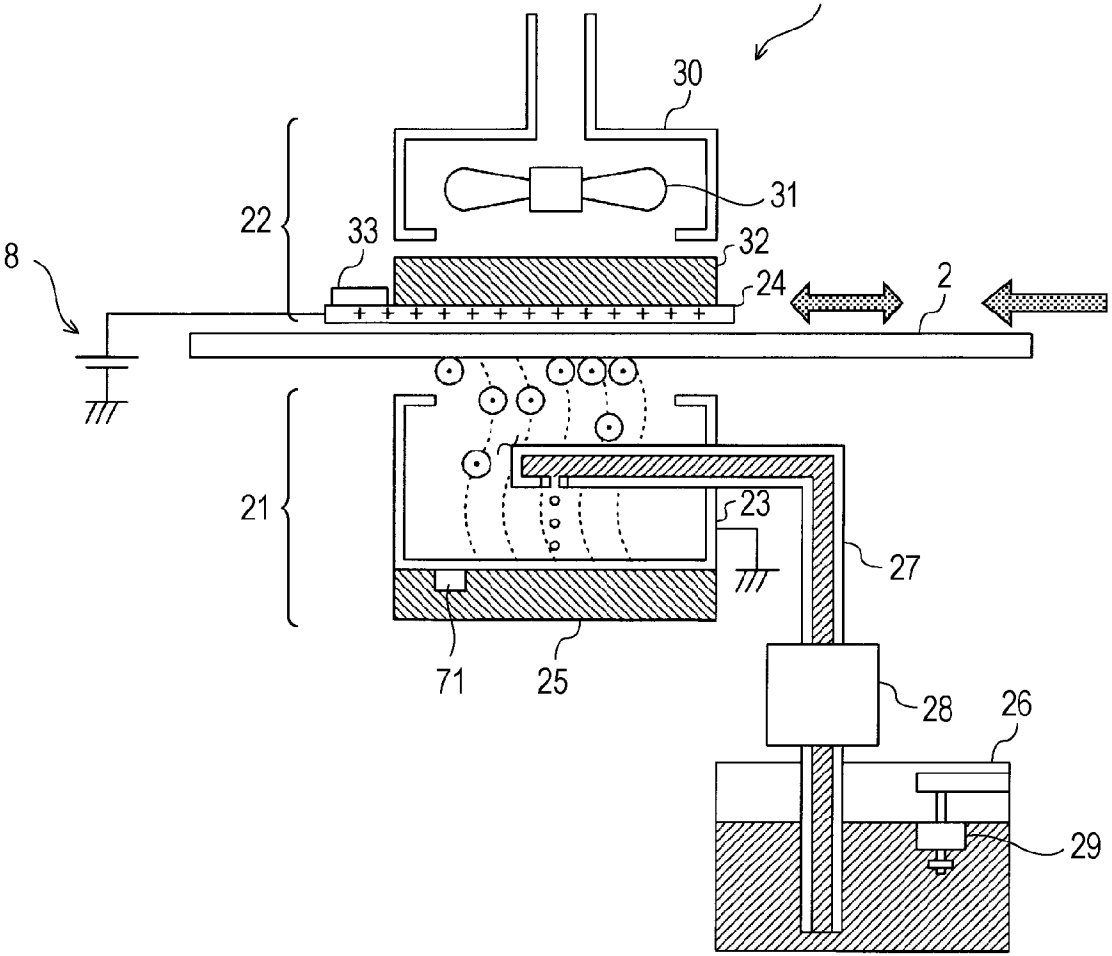
FIG. 2 is a front view illustrating the structure of a vapor supply apparatus shown in FIG. 1.

FIG. 2 shows the overall structure of the vapor supply apparatus 15 according to this embodiment. The vapor supply apparatus 15 according to this embodiment includes a vapor generating device 21 that is provided below a printing medium transport line (the same horizontal surface as the upper outer surface of the transport belt 1) and an upper suction device 22. In this embodiment, the vapor generating device 21 includes a container 23 whose upper surface is open and which is provided immediately below the printing medium transport line, a heater 25 that is provided below the container 23, a temperature sensor 71 that is provided on the bottom of the container 23, an airtight container 26 that is provided slightly below the container 23, a pipe 27 connecting the two containers 23 and 26, a pump 28 provided in the middle of the pipe 27, and a water level sensor 9 that is provided at an upper part inside the container 26. The pump 28 is driven by a pump motor (not shown). A leading end of the pipe 27 inside the container 23 extends to the center of the container 23, and an opening portion through which water droplets pass is formed at a lower part of the leading end of the pipe 27. The suction device 22 includes a hood 30 that is provided immediately above the printing medium transport line so as to cover the vapor generating device 21 and a fan 31 provided in the hood 30. The fan 31 is driven by a fan motor (not shown).

In the vapor generating device 21, the heater 25 heats the bottom of the container 23 until the temperature sensor 71 detects a temperature of about 200° C. In this state, the pump 28 draws water from the lower container 26, and supplies a portion of the water to the container 23 through the pipe 27. Then, the water drops to the bottom of the container 23, and the water droplets are instantaneously heated to vapor. In this state, when the fan 31 of the suction device 22 is driven, the air is sucked from the upper surface of the printing medium 2, that is, a printing surface, and vapor flows from a lower surface of the printing medium 2, that is, a surface opposite the printing surface, to the upper surface of the printing medium 2, that is, the printing surface. In this state, when the printing medium 2 is transported to a transport line, that is, to the upside of the vapor generating device 21, vapor is deposited to the lower surface of the lower surface of the printing medium 2, that is, the surface opposite the printing surface, and the amount of water in the lower surface of the printing medium 2, that is, the surface opposite the printing surface increases. At that time, when ink droplets are discharged onto the printing surface, the difference between the amount of water in the upper surface of the printing medium 2, that is, the printing surface and the amount of water in the lower surface of the printing medium 2, that is, the surface opposite the printing surface is reduced. A control device, which will be described below, controls the supply of vapor to the lower surface of the printing medium 2, that is, the surface opposite the printing surface, on the basis of the printing rate of the printing medium 2, thereby preventing energy loss. In this embodiment, the control device may control the amount of water dropped to the container 23 to adjust the amount of vapor generated.

Further, in this embodiment, an electrode 24 is provided above the vapor generating device 21, that is, in the direction in which vapor is supplied by the vapor supply apparatus 15, and below the suction device 22, that is, at a position facing the printing surface of the printing medium 2. The electrode 24 is connected to a positive terminal of a high voltage power supply 8. A dew condensation preventing heater 32 and a temperature sensor 33 are provided on the electrode 24, and a heater control unit 7 shown in FIG. 1 controls the heater to heat the electrode at a predetermined temperature. The electrode 24, the dew condensation preventing heater 32, and the temperature sensor 33 are reciprocated above the vapor supply apparatus 15 by a reciprocating device 19 from a position facing the vapor supply apparatus 15 to a position not facing the vapor supply apparatus 15. The electrode 24 allows vapor to be effectively deposited on the surface opposite the printing surface of the printing medium 2 to reduce the difference between the amount of water in the printing surface and the amount of water in the surface opposite the printing surface, which will be described below. In addition, the container 23 of the vapor generating device 21 is connected to the ground.

Figure 3:
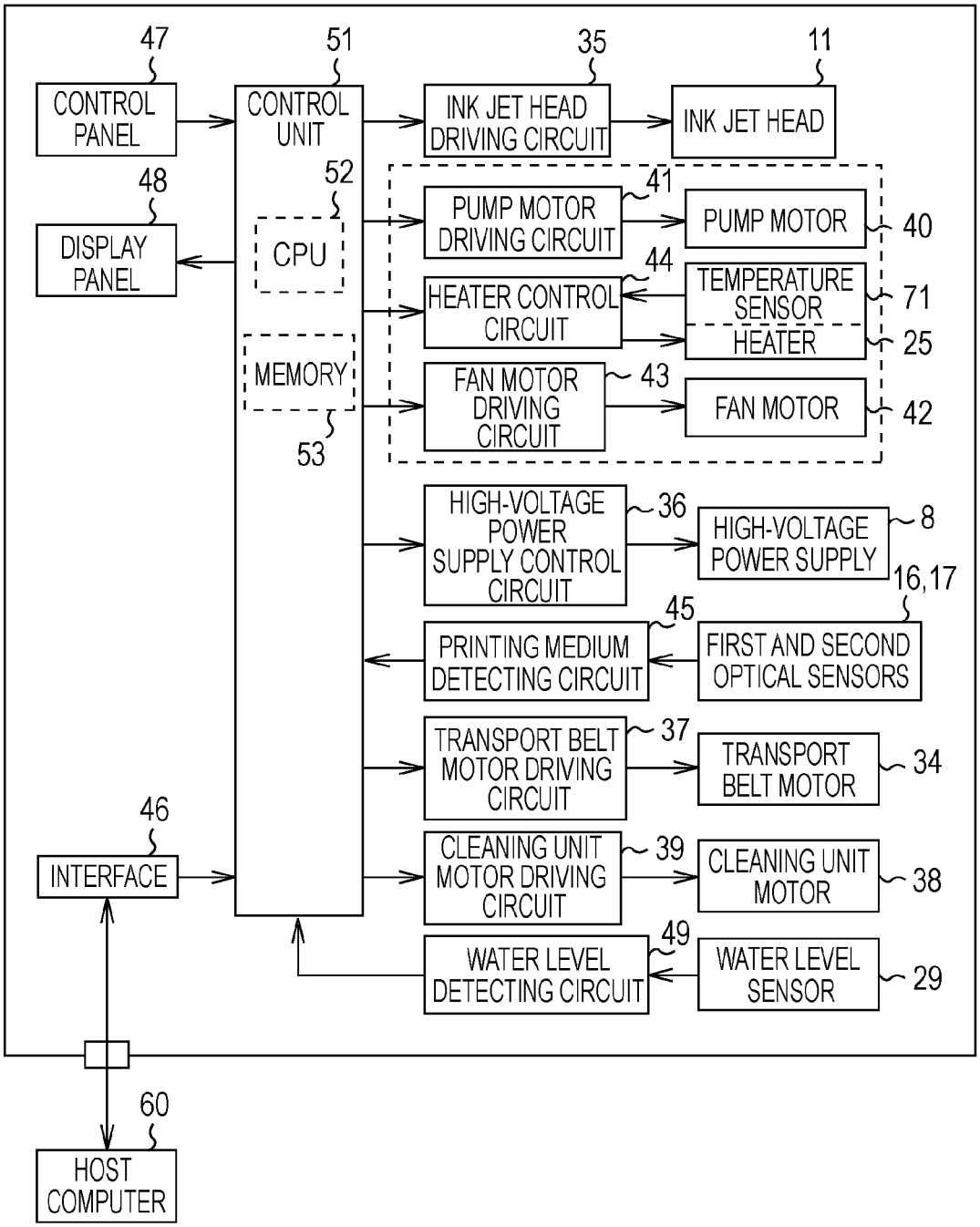
FIG. 3 is a block diagram illustrating the ink jet printer shown in FIG. 1.

FIG. 3 is a block diagram illustrating the ink jet printer according to this embodiment and a host computer 60 for driving the ink jet printer. As the host computer 60, any type of computer system, such as a personal computer or a digital camera, may be used. The ink jet printer includes driving circuits and detecting circuits for reading output signals of sensors. The driving circuits and the detecting circuits are used to drive the ink jet printer, that is, to control cleaning, flushing, and the supply of vapor to a printing medium.

A control unit 51 for controlling the driving of the ink jet printer is provided with a computer system serving as an arithmetic unit. Therefore, the control unit 51 includes a central processing unit (CPU) 52 for performing various control processes and data processing operations and a memory 53 having a RAM forming a main memory unit and a read only memory (ROM). The driving circuits include an ink jet head driving circuit 35 for driving the ink jet head 11, a high voltage power supply control circuit 36 for controlling the high voltage power supply 8, a transport belt driving circuit 37 that drives a transport belt motor 34 for rotating the transport belt 1, a cleaning unit driving circuit 39 that drives a cleaning unit motor 38 for driving a cleaning unit 18, a pump motor driving circuit 41 that drives a pump motor 40 for driving a pump 28, and a fan motor driving circuit 43 that drives a fan motor 42 for driving a suction fan 31. In addition, the detecting circuits include: a printing medium detecting circuit 45 that detects errors in the transport of the printing medium 2, that is, a paper jam, using the first and second optical sensors 16 and 17; a water level detecting circuit 49 that detects the water level of the lower container 26 using a water level sensor 29; and a heater control circuit 44 that controls the heater 25 of the vapor generating device 21 on the basis of the temperature detected by the temperature sensor 71. The control unit 51 is connected to the host computer 60 through an interface 46, and performs printing, cleaning, or flushing according to instructions input from a control panel 47 or instructions from the program executed by the host computer 60. In addition, the control unit 51 controls a display panel 48 to display various information items related to printing or cleaning.

Figure 4A:
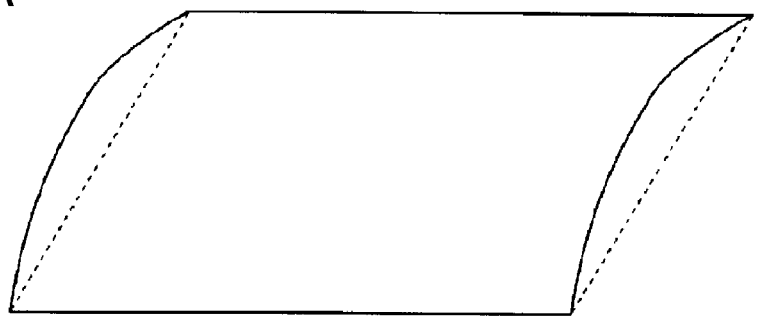
FIG. 4A is a diagram illustrating a small amount of curling after printing.
Figure 4B:
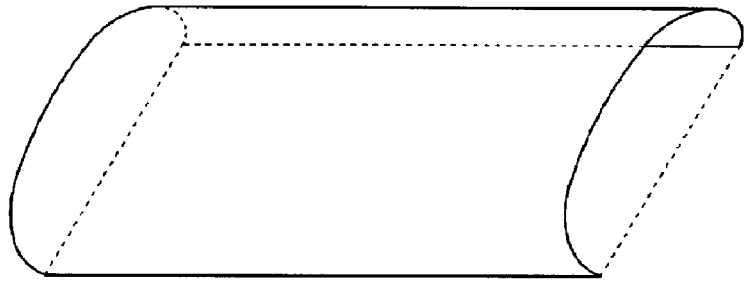
FIG. 4B is a diagram illustrating a large amount of curling after printing.

Next, the operations of the control unit 51 and the vapor supply apparatus 15 preventing the curling of the printing medium 2 will be described below. First, the kind of curling of the printing medium 2 and the main cause thereof will be described. In the line head ink jet printer using aqueous ink, since ink droplets are discharged onto a general printing medium 2 without an ink receiving layer in a short time, cellulose fibers forming the printing medium 2 absorb water, which is a solvent of ink, and expand. As a result, as shown in FIGS. 4A and 4B, curling occurs in the printing medium immediately after printing, which is defined as 'curling after printing'. The larger the amount of ink discharged onto a unit area becomes, the greater the degree of the curling after printing becomes. The degree of the curling after printing depends on the kind of printing medium. When printing is performed on the entire surface of the printing medium 2, the curling after printing occurs over the entire surface of the printing medium 2. When printing is performed on only a portion of the printing medium 2, the curling after printing only partially occurs. In addition, the curling direction of the printed medium is related to the direction in which paper is made in a process of making a general printing medium (which is also called a machine direction), but is not related to the printing direction.

Figure 5A:
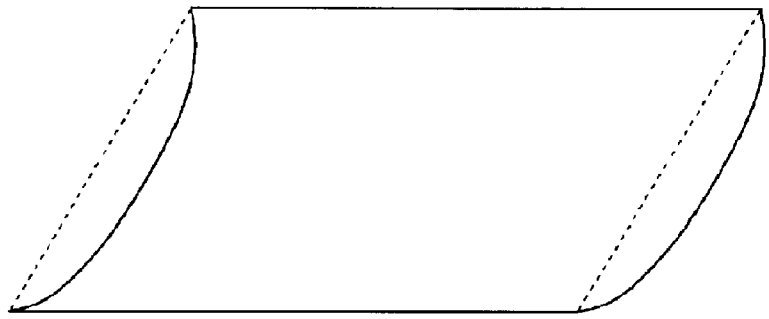
FIG. 5A is a diagram illustrating a small amount of permanent curling.
Figure 5B:
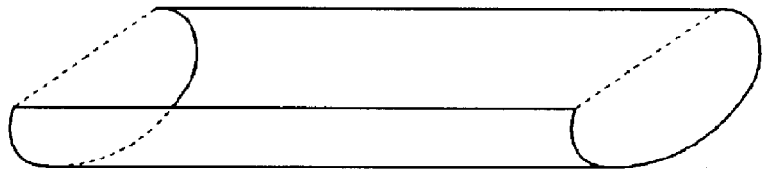
FIG. 5B is a diagram illustrating a large amount of permanent curling.

When the curled printing medium is laid on a plate at a room temperature, the curled printing medium is uncurled after about 10 seconds to 3 minutes. With time, water, which is a solvent of ink, is evaporated, and the printing medium is curled in the opposite direction. After 24 hours at which equilibrium between the dry condition of water and the atmosphere is established, the printing medium is curled in the opposite direction of the curling direction of the printing medium after printing, as shown in FIGS. 5A and 5B, which is defined as permanent curling. The permanent curling is caused by a variation in the relative position between cellulose fibers, which will be described below.

That is, ink droplets are discharged onto the printing surface of the printing medium and then infiltrate into the printing surface of the printing medium. The depth of ink infiltrated into the printing medium depends on the amount of ink discharged to a unit area. For example, when a general sheet having an ink absorption amount of 64 g/m$^2$ is used as the printing medium, the depth of ink infiltrated into the printing medium is about 20 to 80% of the thickness of the printing medium. The cellulose fibers forming the printing medium absorb water, which is a solvent of ink, to expand. Then, before printing, the hydrogen bond of the surfaces of the cellulose fibers is broken, and the relative position between the cellulose fibers is changed. The cellulose fiber expands in the length direction and the width direction at a ratio of about 1:20. That is, the expansion of the cellulose fiber in the length direction is more remarkable than that in the width direction. The cellulose fibers are substantially uniformly aligned in the printing medium, but slightly deviate in the machine direction during a paper making process. As a result, the cellulose fibers expand in a cross machine direction that is orthogonal the machine direction, and the printed medium is curled toward the printing surface. The larger the thickness of a printing medium becomes, the larger the degree of the curling of the printed medium becomes.

Thereafter, water, which is a solvent of ink, evaporates from the printing surface of the printing medium, and the expansion of the cellulose fibers is reduced, which results in a reduction in the curling of the printing medium. As the water evaporates, the expansion of the cellulose fiber becomes smaller, and the relative position between the cellulose fibers varies. The amount of water contained in the printing medium is reduced to be equal to the amount of water contained in the ambient air. In this dry process, the positional relationship between the cellulose fibers is established such that the density of the cellulose fibers increases. Therefore, the printing surface of the printing medium is more contracted than before printing, so that the printing medium is curled to the side of the printing medium opposite the printing surface. When a remarkable permanent curling occurs in the printing medium, the printing medium is curled in a cylindrical shape, and the value of a product is remarkably lowered.

Figure 6:
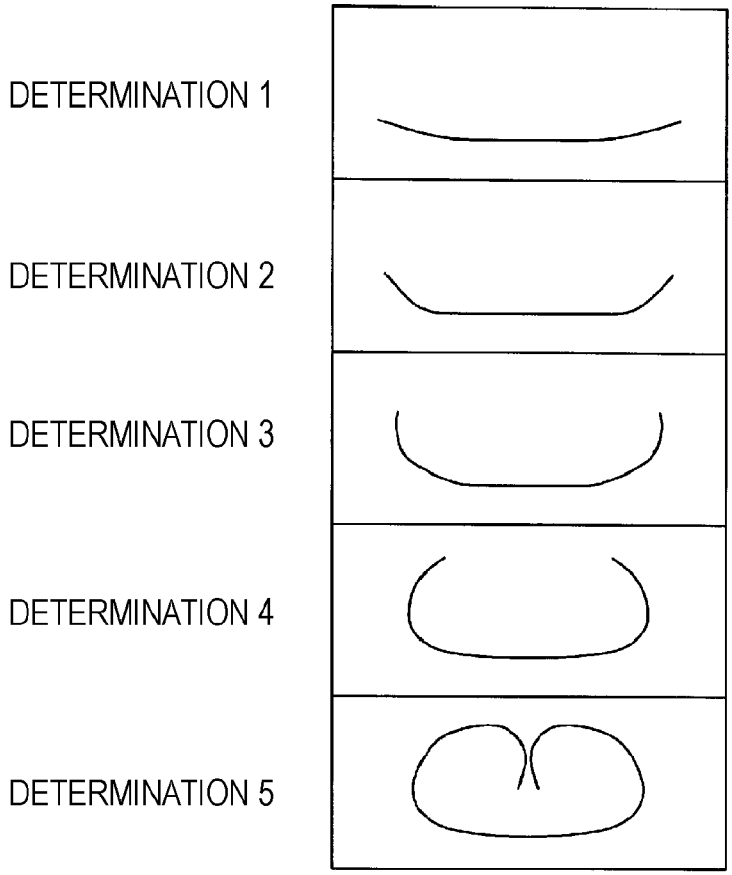
FIG. 6 is a diagram illustrating a criterion for the permanent curling.

Experiments are conducted to check whether the curling is reduced by the supply of vapor (water) to the printing medium. In the experiments, printing is performed on one printing surface of a printing medium, and water is supplied to the printing medium under various conditions. Then, after 24 hours, the state of curling is determined. The determination includes five levels as shown in FIG. 6. Determination 1 indicates the smallest curling, and Determination 5 indicates the largest curling. That is, the higher the determination level becomes, the less the degree of the permanent curling becomes. As a printing pattern, so-called black solid printing is performed on a printing medium having an A4 size (a general sheet of 64 g/m$^2$), with a while line having a width of 7 mm remaining at the edge of the printing medium. Methods of supplying water and the determination results of the permanent curling are shown in Table 1. The temperature of heating steam ejected to the front or rear surface of the printing medium is in a range of 40 to 50° C.

TABLE 1

| Kind of water supplied | For printing surface | Determination of permanent curling |
|---|---|---|
| 1) Heating steam | Ejection to printing surface | Determination 5 |
| 2) Heating steam | Ejection to surface opposite printing surface | Determination 1 |
| 3) Ambient vapor (humidified vapor) | Ejection to printing surface | Determination 4 |
| 4) Ambient vapor (humidified vapor) | Ejection to surface opposite printing surface | Determination 4 |
| 5) No water is supplied | | Determination 5 |

The experiments prove that, when heating steam is ejected to the surface opposite the printing surface, the permanent curling is reduced. That is, when heating steam is ejected to the surface of the printing medium opposite the printing surface of the printing medium to reduce the difference between the amount of water in the printing surface of the printing medium and the surface opposite the printing surface, the permanent curling is reduced. When the molecular weight of gas is M, a gas constant is R, and an absolute temperature is T, the average transfer rate V of gas is represented by $V=(RT/M)^{1/2}$. For example, the average transfer rate of gas is 368 m/sec at a temperature of 20° C., 380 m/sec at a temperature of 40° C., and 392 m/sec at a temperature of 60° C. The transfer rate of vapor is considerably higher than that of water. In addition, the experiments prove that, when the temperature of heating steam increases to 130 to 150° C. and the heating steam is ejected to the surface opposite the printing surface, curling occurs in the opposite direction of the permanent curling. Further, the experiments prove that the curling depends on the transport speed of the printing medium. That is, when the printing medium is transported at a high speed, the amount of heating steam supplied increases to reduce the curling. On the other hand, when the printing medium is transported at a low speed, the amount of heating steam supplied decreases to reduce the curling. The experiments prove that it is necessary to set the temperature of heating steam and the amount of heating steam supplied, according to the type of printing medium and the transport speed of the printing medium.

Next, the ratio of the number of ink droplet discharging nozzles to the total number of nozzles (hereinafter, referred to as a printing rate) will be described below. First, the number of ink droplets discharged to a matter to be subjected to so-called solid printing is set according to printing resolution or the type of printing medium. For example, when a printing resolution is 360 dpi in the vertical direction×360 dpi in the horizontal direction, a general sheet without an ink receiving layer is used as the printing medium, and pigment ink is used, it is defined that a printing rate is 100% when ink droplets each having a weight of X ng are discharged from all of the nozzles on the entire surface of the printing surface of the printing medium. That is, it is defined that a printing rate is 100% when ink droplets each having a minimum weight of X ng are discharged in a so-called solid printing method. For example, as in this embodiment, in order to obtain a printing rate of 100% in four color printing, the printing rate of each color may be set to 25%, or the printing rates of yellow, magenta, cyan, and black may be set to 30%, 20%, 30%, and 20%, respectively, thereby obtaining a printing rate of 100% in total. In an ink jet head capable of controlling the size of an ink droplet, for example, in the case in which a large (L) dot is set to X ng, a middle (M) dot is set to 2X/3 ng, and a small (S) dot is set to X/3 ng, when only the M dots are printed, the printing rate is 100×2/3=66.7%, and when only the S dots are printed, the printing rate is 100×1/3=33.3%. In addition, an allowable printing rate depends on the kind of printing medium or ink and a printing mode, that is, whether printing is performed on both sides of a printing medium. When printing is performed on only one side of a printing medium, it is possible to perform printing at a printing rate of about 100 to 200%. However, since the allowable printing rate depends on the determination of a printing quality, the printing rate may depend on the type of ink jet printer.

The minimum value of the printing rate at which the permanent curling occurs in a single-sided printing is calculated by experiments using the concept of the printing rate. As a result, no permanent curling substantially occurs at a printing rate lower than about 40%, and the permanent curling substantially occurs at a printing rate more than about 40%. In this case, the term 'substantially' is used since the degree of the permanent curling when printing is uniformly performed on the entire surface of a printing medium is different from that when printing is partially performed on the printing medium at the same printing rate. As can be seen from the following Table 2, when the printing rate is more than 40% in the single-side printing, the vapor supply apparatus 15 is used to supply vapor to the surface opposite the printing surface to adjust the amount of water in the printing surface and the surface opposite the printing surface, thereby reducing the permanent curling.

TABLE 2

| | Case | |
|---|---|---|
| | 1 | 2 |
| Printing rate (%) | Less than 40% | More than 40% |
| Adjustment of water | No | Yes |

In this embodiment, the control unit 51 controls the vapor supply apparatus 15 to supply vapor to the surface opposite the printing surface having a printing rate more than 40% to adjust the amount of water in the printing surface and the surface opposite the printing surface. For an error in the transport of a printing medium inside the vapor supply apparatus 15, that is, so-called paper jam, the time required for the printing medium to pass between the first optical sensor 16 and the second optical sensor 17 is monitored. When the time is longer than a predetermined time, it is determined that paper jam occurs, and the operation of the heater 25 and the rotation of the fan 31 driven by the fan motor 42 stop. In addition, when the level of water in the lower container 26 detected by the water level sensor 29 is less than a predetermined value, the control unit gives an alarm to the user to supply water.

Next, the reason why the electrode 24 is provided in the vapor supply apparatus 15 of the ink jet printer according to this embodiment will be described below. As described above, in order to prevent the permanent curling of the printing medium 2, it is preferable to reduce the difference between the amount of water in the printing surface of the printing medium 2 and the amount of water in the surface opposite the printing surface. For example, in the solid printing method, it is preferable to eject vapor to the entire surface opposite the printing surface. However, actually, a printed matter includes a printed region, that is, a region having ink droplets discharged therein, and a non-printed region, that is, a region without ink droplets. The region having the ink droplets discharged therein is also divided into a portion having a lot of ink droplets discharged therein (a printed color is deep, and the printed color is complicated with respect to the color of ink) and a portion having few ink droplets discharged therein (a printed color is light, and the printed color is simple with respect to the ink droplet).

Figure 7:
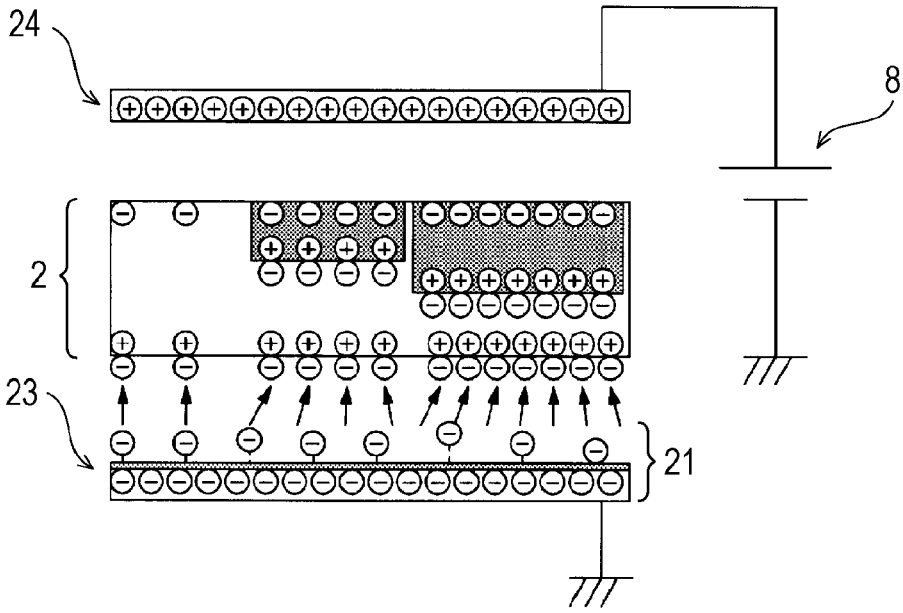
FIG. 7 is a diagram illustrating the effects when vapor ejected from the vapor supply apparatus shown in FIG. 2 is deposited on the surface of a printing medium opposite a printing surface of the printing medium.

When the printing medium 2 is moved in the vapor supply apparatus 15, the reciprocating device 19 moves the electrode 24 above the vapor generating device 21. FIG. 7 is a diagram schematically illustrating the electrical relationship between the printing medium 2 and the vapor generating device 21 (the vapor supply apparatus 15) including the container 23 and the electrode 24. In FIG. 7, the vertical direction of the printing medium 2 indicates thickness. In addition, in FIG. 7, no ink droplet is discharged to a non-hatched region, few ink droplets are discharged to a portion of the hatched region having a small thickness, and a lot of ink droplets are discharged to the other portion of the hatched region having a large thickness. Negative charge having a polarity opposite to that of the electrode 24 is induced in the printing surface of the printing medium 2, and positive charge is induced in the surface opposite the printing surface of the printing medium 2, by an electric field formed between the electrode 24 connected to the positive terminal of the high voltage power supply 8 and the container 23 connected to the ground.

Meanwhile, since the conductivity of aqueous ink is in a range of about 0.4 to 1.3 mS/cm, the aqueous ink is substantially considered as a conductor. Therefore, the electric field is concentrated on a portion having a lot of ink droplets discharged therein. Ink (conductor) electrons move to the printing surface of the printing medium 2 facing the electrode 24, so that the printing surface is charged with negative electricity. In addition, atomic nucleuses remain on the surface opposite the printing surface, that is, the surface of the printing medium facing the container 23, so that the opposite surface is charged with positive electricity. The number of charges depends on the number of ink droplets, and a large number of charges are generated in the printing medium. The potential of a portion of the printing medium 2 may be equal to that of the electrode 24. Therefore, the number of ink droplets discharged (the depth of ink infiltrated into the printing medium=thickness) depends on the number of positive charges generated in the surface opposite the printing surface of the printing medium 2. That is, in the region having the ink droplets discharged therein, the electric field passes from the positive charges of the ink toward the container 23. When the depth of ink infiltrated into the printing medium is large, the distance between the positive charges of the ink and the surface opposite the printing surface is short, which causes the positive charges to be concentrated on the surface opposite the printing surface of the printing medium 2. Meanwhile, in the region without ink droplets, a large number of air layers exist in the printing medium (in the case of a general sheet) 2 mainly composed of cellulose fibers, and a dielectric constant is small. Therefore, in the region without ink droplets, the number of positive charges generated in the surface opposite the printing surface is smaller than that in a portion in which ink is infiltrated.

Consequently, in the same printing medium 2, a larger amount of vapor charged with negative electricity is deposited to a portion of the opposite surface corresponding to a portion of the printing surface having the ink droplets discharged therein, as compared to the surface opposite the printing surface without the ink droplet, due to the electric field. In the same region having ink droplets discharged therein, a larger amount of vapor charged with negative electricity is deposited to a portion of the opposite surface corresponding to a portion of the printing surface having a large number of ink droplets discharged therein, as compared to a portion of the opposite surface corresponding to a portion of the printing surface having few ink droplets discharged therein. Therefore, the amount of vapor deposited to the surface opposite the printing surface is automatically controlled according to whether the ink droplets are discharged to the printing surface and the number of ink droplets discharged to the printing surface. Considering the entire surface of the printing medium 2, the difference between the amount of water in the printing surface of the printing medium 2 and the amount of water in the surface opposite the printing surface is uniformly and effectively reduced, which makes it possible to effectively and reliably prevent the permanent curling of the printing medium 2. The polarity of the surface opposite the printing surface of the printing medium 2 charged with positive electricity is cancelled by the deposition of vapor charged with negative electricity.

As described above, according to the ink jet printer of this embodiment, the vapor supply apparatus 15 provided at the downstream side of the ink jet head 11 in the direction in which the printing medium is transported supplies vapor to the surface opposite the printing surface of the printing medium 2 onto which aqueous ink droplets are discharged from the ink jet head 11, without coming into contact with the printing medium, and the vapor supplied from the vapor supply apparatus 15 is deposited to the surface opposite the printing surface of the printing medium 2 by electrostatic force. Therefore, errors in the transport of the printing medium 2 do not occur, and charge is likely to be concentrated on aqueous ink droplets, which are conductors, resulting in a strong electric field. The strong electric field enables a larger amount of vapor to be deposited to the printing medium. Therefore, a large amount of vapor is deposited to a portion having a large number of ink droplets discharged therein. As a result, the difference between the amount of water in the printing surface of the printing medium 2 and the amount of water in the surface opposite the printing surface is reduced, which makes it possible to effectively and reliably prevent the permanent curling of the printing medium 2.

Further, in this embodiment, vapor is deposited to the surface opposite the printing surface of the printing medium 2 by the electrode 24 that is provided orthogonal to the direction in which vapor is supplied by the vapor supply apparatus 15 and at a position facing the printing surface of the printing medium 2. Therefore, it is possible to effectively prevent the permanent curling of the printing medium 2 with a simple structure.

In addition, since the dew condensation preventing heater 32 is provided on the electrode 24, it is possible to prevent dew condensation on the electrode 24 or the drop of the dew to the printing medium 2 due to the deposition of vapor.

Furthermore, in this embodiment, vapor is generated on the side of the printing medium 2 opposite the printing surface of the printing medium 2 having ink droplets discharged from the ink jet head 11, and the air is absorbed from the printing surface of the printing medium 2, which results in the flow of vapor from the side of the printing medium opposite the printing surface toward the printing surface. Therefore, the vapor generated on the side of the printing medium 2 opposite the printing surface of the printing medium 2 is actively deposited to the surface opposite the printing surface of the printing medium 2. As a result, the difference between the amount of water in the printing surface of the printing medium 2 and the amount of water in the opposite surface thereof is effectively reduced.

Moreover, in this embodiment, water is dropped to the heated container 23 (heated member) to generate vapor. Therefore, it is possible to simplify the structure of an apparatus, easily implement the invention, and generate a large amount of vapor in a short time.

In addition, the supply of vapor from the vapor supply apparatus 15 to the printing medium 2 is controlled according to the ratio of the number of nozzles discharging ink droplets from the ink jet head 11 to the total number of nozzles (printing rate). Therefore, for example, in the case in which the ratio of the number of nozzles discharging ink droplets from the ink jet head 11 to the total number of nozzles (printing rate) is more than a predetermined value, that is, a large amount of ink is discharged onto one printing medium, when the vapor supply apparatus 15 supplies vapor to the printing medium 2 in a non-contact manner, it is possible to reduce energy consumption and prevent the permanent curling of the printing medium 2.

Figure 8:
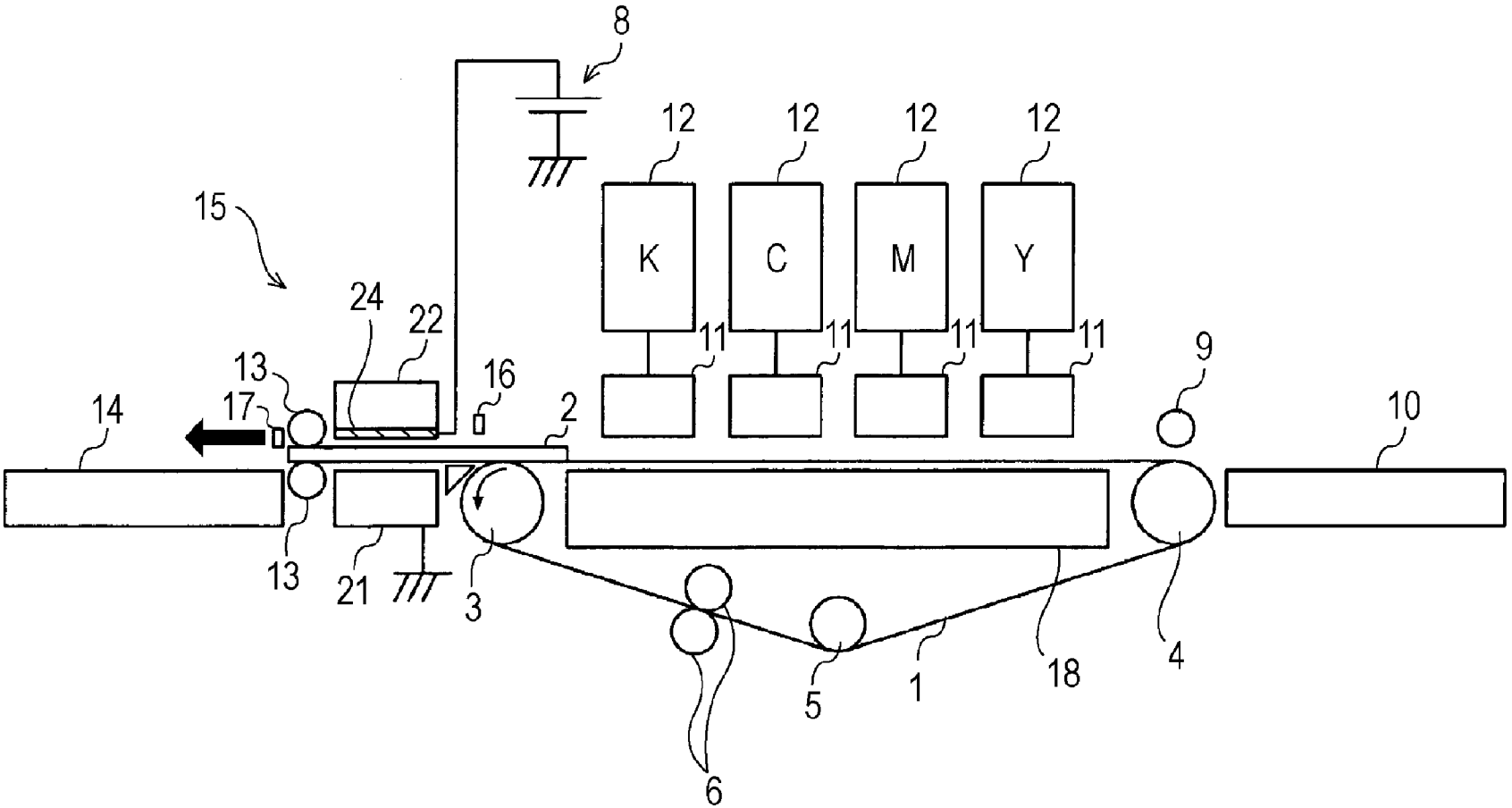
FIG. 8 is a front view schematically illustrating the structure of an ink jet printer according to a second embodiment of the invention.
Figure 9:
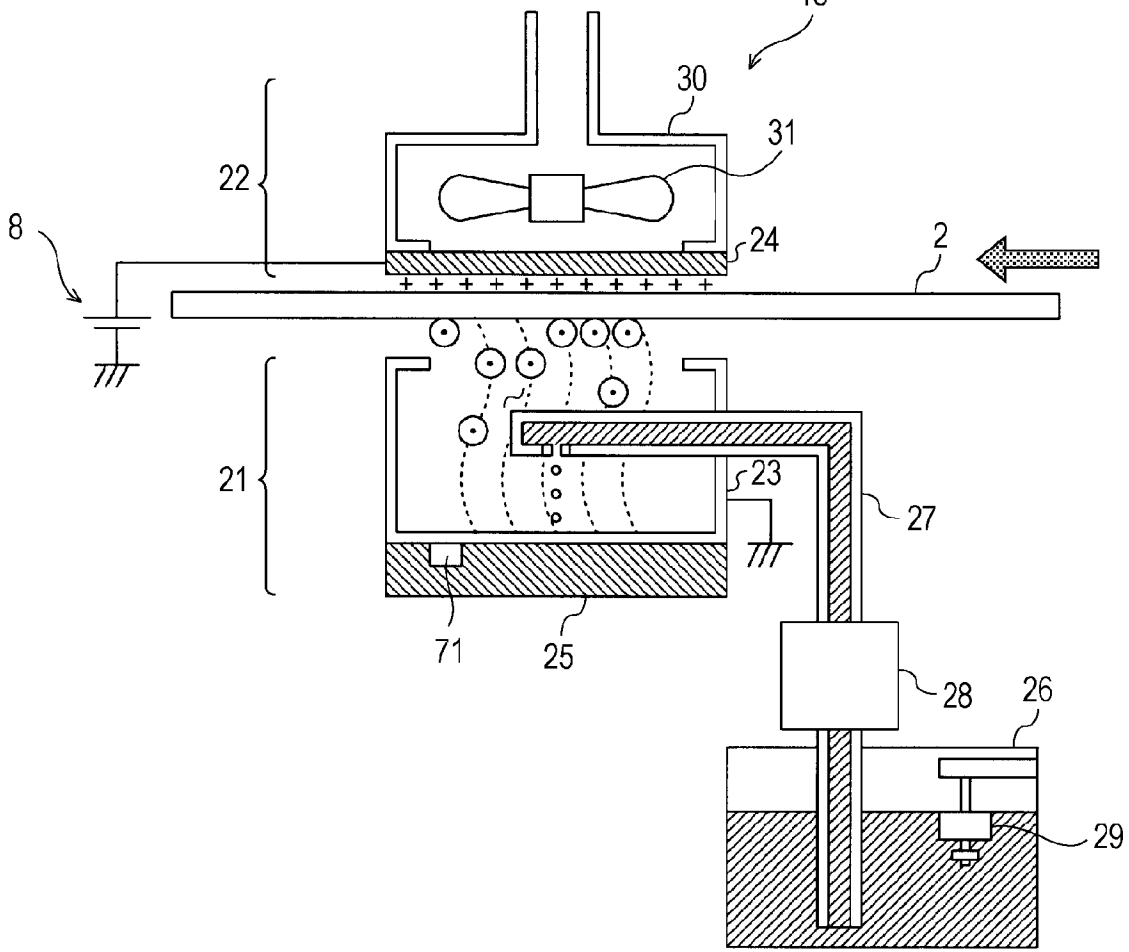
FIG. 9 is a front view illustrating the structure of a vapor supply apparatus shown in FIG. 8.

Next, an ink jet printer according to a second embodiment of the invention will be described with reference to FIG. 8. The schematic structure of the ink jet printer according to the second embodiment is similar to that of the ink jet printer according to the first embodiment shown in FIG. 1 except for the structure of the vapor supply apparatus 15 of the ink jet printer shown in FIG. 1. FIG. 9 is a diagram illustrating the overall structure of a vapor supply apparatus 15 of the ink jet printer according to the second embodiment. In this embodiment, similarly, the vapor generating device 21 is provided so as to face the printing surface of the printing medium 2, and the suction device 22 is provided so as to face the surface opposite the printing surface. The vapor generating device 21 and the suction device 22 have the same structure as those according to the first embodiment shown in FIG. 2.

In this embodiment, an electrode 24 formed of a metal mesh material is provided above the vapor generating device 21 in the direction in which the vapor supply apparatus 15 supplies vapor and below the suction device 22, that is, at a position facing the printing surface of the printing medium 2. Therefore, a plurality of vapor vents are formed in the metal mesh electrode 24. Therefore, vapor supplied from the vapor generating device 21 passes through the vapor vents of the electrode 24 to the suction device 22, and then discharged to the outside, which makes it possible to prevent dew condensation on the electrode 24. As a result, in this embodiment, the dew condensation preventing heater, the temperature sensor, the heater control unit, and the reciprocating device are omitted. In addition, similar to the first embodiment, the electrode 24 is connected to a positive terminal of the high voltage power supply 8. Therefore, vapor is effectively deposited to the surface opposite the printing surface of the printing medium 2, which makes it possible to effectively reduce the difference between the amount of water in the printing surface and the amount of water in the opposite surface thereof, similar to the first embodiment.

As described above, according to the ink jet printer of this embodiment, in addition to the effects of the first embodiment, it is possible to prevent dew condensation on the electrode 24 or the drop of dew to the printing medium 2 due to the deposition of vapor by forming the vapor vents in the electrode 24.

As in this embodiment, when vapor charged with any polarity, for example, negative electricity is directly sucked by the suction device 22, it is preferable that the electrode 24 be insulated from a duct communicating with the hood 31 or the duct be formed of an insulating material.

Next, an ink jet printer according to a third embodiment of the invention will be described below with reference to FIG. 10. The schematic structure of the ink jet printer according to the third embodiment is similar to that of the ink jet printer according to the first embodiment shown in FIG. 1 except for the structure of the vapor supply apparatus 15 of the ink jet printer shown in FIG. 1. FIG. 11 is a diagram illustrating the overall structure of a vapor supply apparatus 15 of the ink jet printer according to this embodiment. In this embodiment, similarly, the vapor generating device 21 is provided so as to face the printing surface of the printing medium 2, and the suction device 22 is provided so as to face the surface opposite the printing surface. The structures of the vapor generating device 21 and the suction device 22 are similar to those according to the first embodiment shown in FIG. 2 except that the electrode is omitted.

Figure 10:
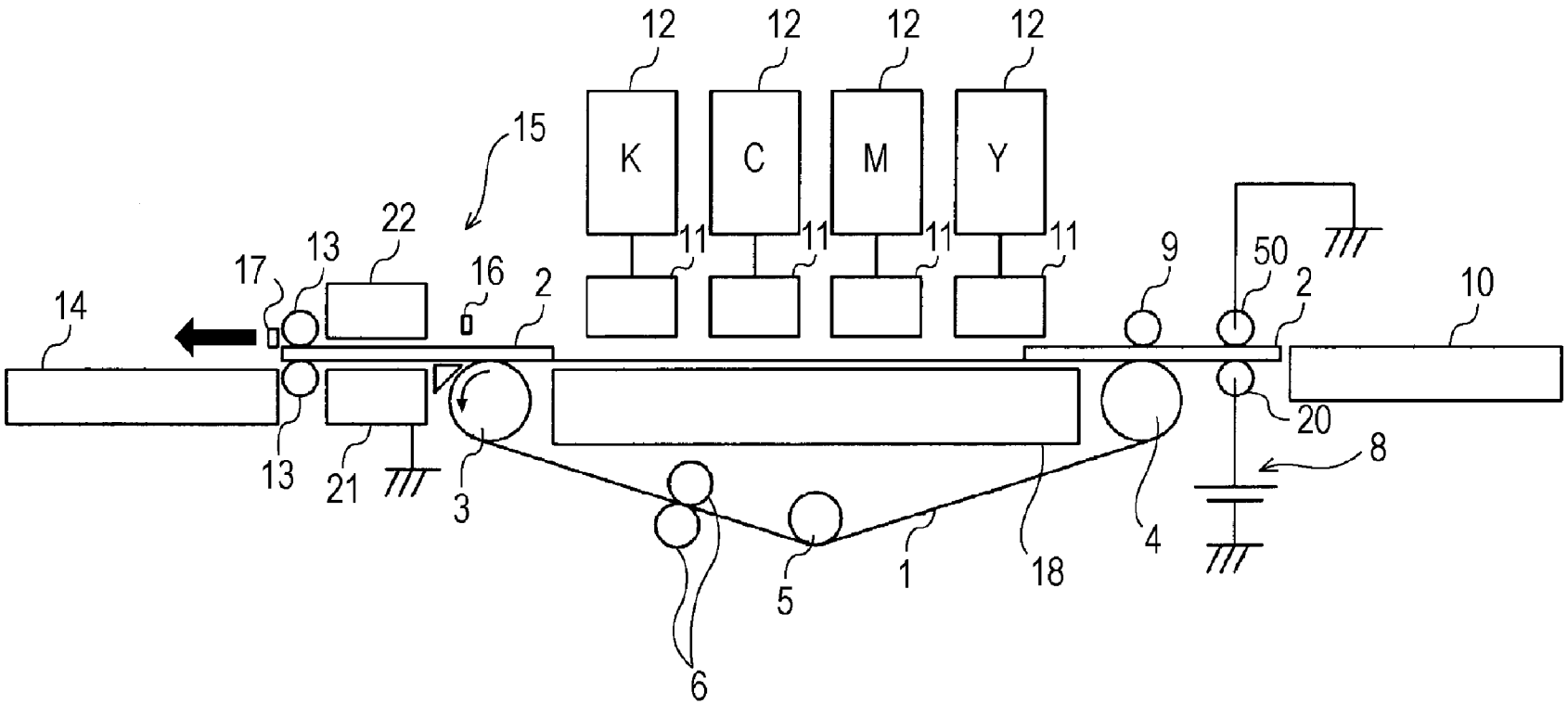
FIG. 10 is a front view schematically illustrating the structure of an ink jet printer according to a third embodiment of the invention.
Figure 11:
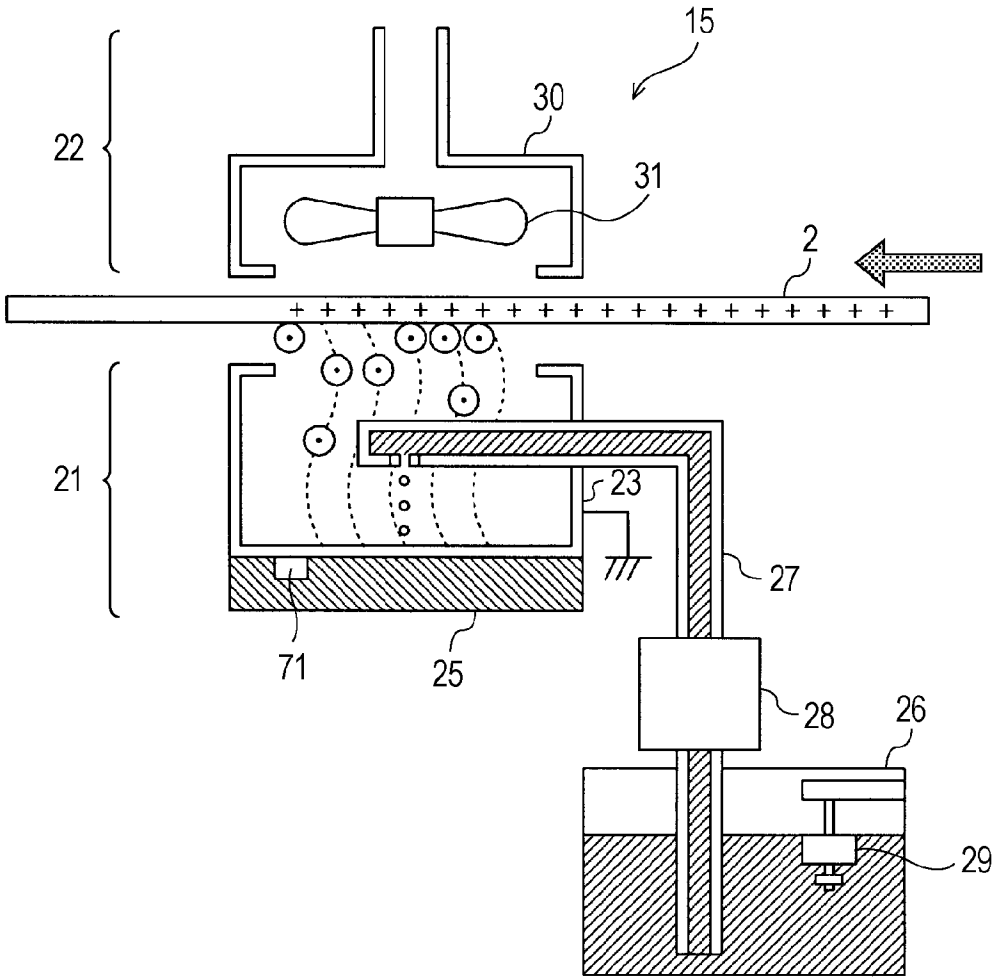
FIG. 11 is a front view illustrating the structure of a vapor supply apparatus shown in FIG. 10.

In this embodiment, as shown in FIG. 10, a printing medium charging roller 20, serving as a charging unit that comes into contact with the surface opposite the printing surface of the printing medium 2, is provided at the upstream side of the ink jet head 11 in the direction in which a printing medium is transported, specifically, at the upstream side of the transport belt 1 in the direction in which the printing medium is transported and below a printing medium transport line. In addition, the printing medium charging roller 20 is connected to a positive terminal of the high voltage power supply 8. A ground roller 50 is provided opposite to the printing medium charging roller 20 with the printing medium transport line interposed therebetween, and the ground roller 50 is connected to the ground.

Therefore, in this embodiment, when the printing medium 2 passes between the printing medium charging roller 20 and the ground roller 50, the surface opposite the printing surface is charged with positive electricity, and the printing surface is charged with negative electricity. When ink droplets are discharged from the ink jet head 11 to the printing medium 2 having the printing surface charged with negative electricity, as described above, a larger number of negative charges are concentrated on a portion having ink droplets discharged therein than on a portion without ink droplets, and on a portion having a large number of ink droplets discharged therein than on a portion having few ink droplets discharged therein. Then, positive charges move to the opposite sides of the portions, that is, the surface opposite the printing surface. Accordingly, in this embodiment, similar to the first embodiment, vapor is effectively deposited on the surface opposite the printing surface of the printing medium 2, and the difference between the amount of water in the printing surface and the amount of water in the opposite surface thereof is effectively reduced.

As described above, according to the ink jet printer of this embodiment, in addition to the effects of the first and second embodiments, it is possible to simplify the structure of an apparatus and effectively prevent the permanent curling of the printing medium 2 by using the printing medium charging roller 20 (printing medium charging unit) for charging the printing medium 2 to deposit vapor to the surface opposite the printing surface of the printing medium 2.

In addition, the printing medium charging roller 20 (printing medium charging unit) is provided at the upstream side of the ink jet head 11 in the direction in which a printing medium is transported, which makes it easy to implement the invention.

For example, a charging brush or a corona discharge device, which will be described below, may be used instead of the charging roller.

Next, an ink jet printer according to a fourth embodiment of the invention will be described with reference to FIG. 12. The schematic structure of the ink jet printer according to the fourth embodiment is similar to that of the ink jet printer according to the first embodiment shown in FIG. 1 except for the structure of the vapor supply apparatus 15 of the ink jet printer shown in FIG. 1. The vapor supply apparatus 15 of the ink jet printer according to this embodiment has the same structure as that according to the third embodiment shown in FIG. 11, but differs from that according to the first embodiment shown in FIG. 2 in that the electrode is omitted.

Figure 12:
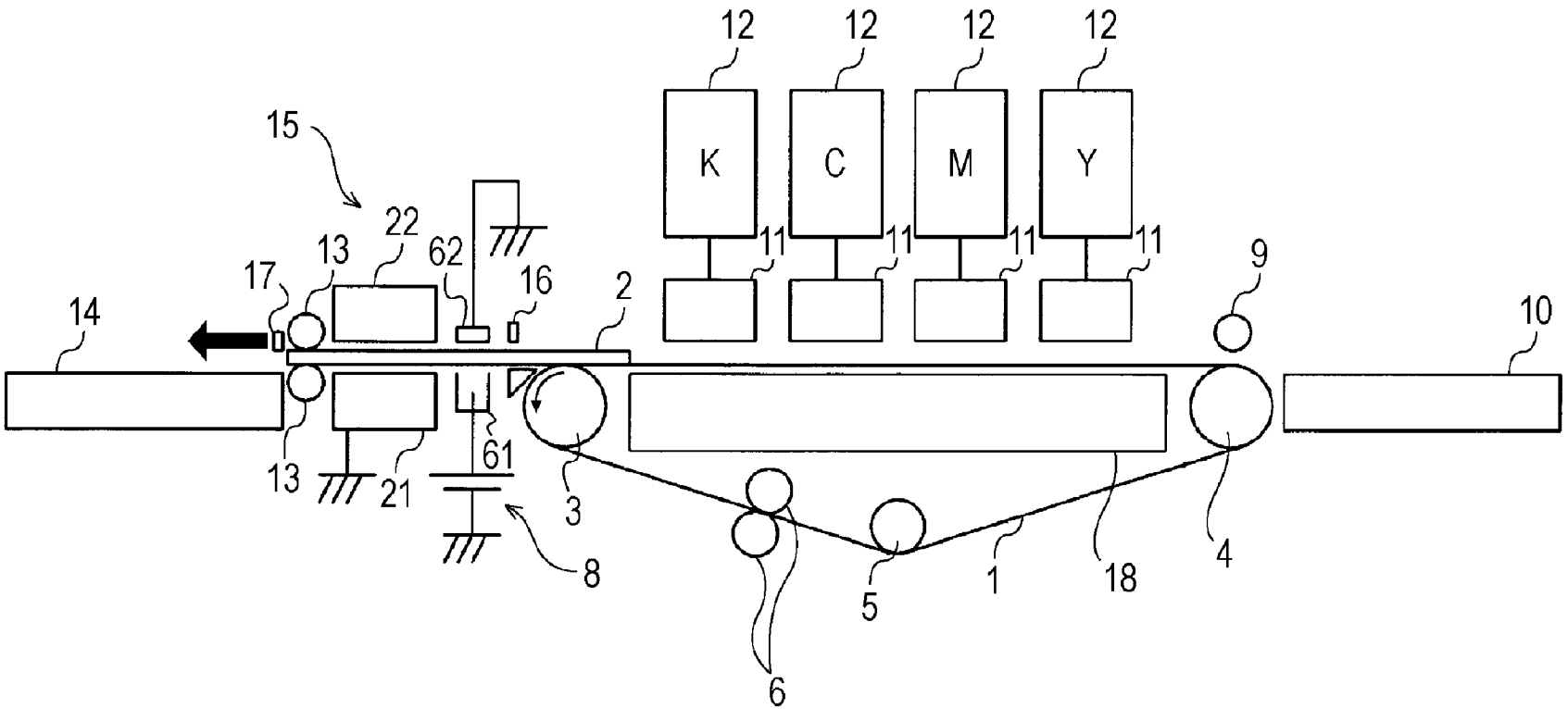
FIG. 12 is a front view schematically illustrating the structure of an ink jet printer according to a fourth embodiment of the invention.

In this embodiment, as shown in FIG. 12, a corona discharge device 61, serving as a charging unit, is provided at the downstream side of the ink jet head 11 in the direction in which a printing medium is transported, specifically, at the downstream side of the transport belt 1 in the direction in which the printing medium is transported, at the upstream side of the vapor supply apparatus 15 in the direction in which the printing medium is transported, and below a printing medium transport line. In addition, the corona discharge device 61 is connected to a positive terminal of the high voltage power supply 8. A ground electrode 62 is provided opposite to the corona discharge device 61 with the printing medium transport line interposed therebetween, and the ground electrode 62 is connected to the ground.

The corona discharge device 61 is formed of a non-contact discharge type scorotron charging device or corotron charging device. When the corona discharge device 61 connected to the positive terminal of the high voltage power supply 8 generates corona discharge, the surface opposite the printing surface of the printing medium 2 is charged with positive electricity, and the printing surface is charged with negative electricity. As described above, a larger number of negative charges are concentrated on a portion having ink droplets discharged therein than on a portion without ink droplets, and on a portion having a large number of ink droplets discharged therein than on a portion having few ink droplets discharged therein. Then, positive charges move to the opposite sides of the portions, that is, the surface opposite the printing surface. Accordingly, in this embodiment, similar to the first embodiment, vapor is effectively deposited on the surface opposite the printing surface of the printing medium 2, and the difference between the amount of water in the printing surface and the amount of water in the opposite surface thereof is effectively reduced.

As described above, according to the ink jet printer of this embodiment, in addition to the effects of the first to third embodiments, it is possible to easily implement the invention by providing the corona discharge device 61 (printing medium charging unit) at the downstream side of the ink jet head 11 in the direction in which a printing medium is transported and at the upstream side of the vapor supply apparatus 15 in the direction in which a printing medium is transported.

For example, a charging brush or a charging roller may be used instead of the corona discharge device.

In the above-described embodiments, the container 23 of the vapor generating device 21 is connected to the ground, but the invention is not limited thereto. Any connection structure may be used as long as it can generate the difference between the potential of the printing surface of the printing medium 2 and the potential of the opposite surface thereof. For example, as described in the embodiments, when the surface opposite the printing surface of the printing medium 2 is charged with positive electricity, the container of the vapor generating device 21 may be charged with negative electricity. Further, as in the above-described embodiments, when the surface opposite the printing surface of the printing medium 2 is charged with negative electricity, an electrolyte containing Na+ or K+ ions may be used as water in order to accelerate the electrification of vapor.

Furthermore, in the above-described embodiments, the ink jet printer according to the invention is applied to a so-called line head ink jet printer, but the invention is not limited thereto. The ink jet printer according to the invention can be applied to all types of ink jet printers using aqueous ink including multifunction printers.

What is claimed is:

1. An ink jet printer comprising:

ink jet heads that discharge aqueous ink droplets onto a printing surface of a printing medium that is transported in a predetermined direction;

a vapor supply unit that is provided at a downstream side of the ink jet heads in a direction in which the printing medium is transported and supplies vapor to a surface of the printing medium opposite the printing surface of the printing medium having the liquid droplets discharged from the ink jet heads in a non-contact manner;

a vapor supply control unit that controls the supply of the vapor from the vapor supply unit to the printing medium according to the ratio of the number of nozzles discharging the ink droplets from the ink jet heads to the total number of nozzles; and a vapor electrostatic deposition unit that deposits the vapor supplied from the vapor supply unit to the surface of the printing medium opposite the printing surface of the printing medium using electrostatic force, wherein the vapor electrostatic deposition unit includes a printing medium charging unit for charging the printing medium, and wherein the vapor supply unit includes:

a vapor generating unit that generates vapor on the side of the printing medium opposite the printing surface of the printing medium onto which the ink droplets are discharged from the ink jet heads; and a suction unit that sucks air from the printing surface of the printing medium to generate the flow of vapor from the side of the printing medium opposite the printing surface to the printing surface.

2. The ink jet printer according to claim 1, wherein the vapor electrostatic deposition unit includes a pair of electrodes that are provided so as to be opposite to each other in a direction in which the vapor supply unit supplies the vapor and to face the printing medium.

3. The ink jet printer according to claim 2, wherein the electrode includes a dew condensation preventing heater.

4. The ink jet printer according to claim 2, further comprising an electrode formed above the vapor generating unit in the direction that the vapor flows, and wherein vapor vents are formed in the electrode.

5. The ink jet printer according to claim 1, wherein the printing medium charging unit is provided at an upstream side of the ink jet heads in the direction in which the printing medium is transported.

6. The ink jet printer according to claim 1, wherein the printing medium charging unit is provided at the downstream side of the ink jet heads and at the upstream side of the vapor supply unit in the direction in which the printing medium is transported.

7. The ink jet printer according to claim 1, wherein the vapor generating unit generates the vapor by dropping water onto a heated member.

* * * * *